US005873613A

United States Patent [19]

Bliehall et al.

[11] Patent Number: 5,873,613

[45] Date of Patent: Feb. 23, 1999

[54] DEVICE USED IN THE RETRIEVAL OF CLIMBING EQUIPMENT

[76] Inventors: James C. Bliehall; Cindi M. Bliehall, both of 6015 Candace Ave., Inver Grove Heights, Minn. 55076

[21] Appl. No.: 858,510

[22] Filed: May 19, 1997

[51] Int. Cl.[6] ..... B25J 1/00

[52] U.S. Cl. ..... 294/1.1; 24/115 R

[58] Field of Search ..... 294/1.1, 19.1, 294/66.1, 66.2, 82.1, 82.11; 248/925; 24/115 R, 115 H, 115 K, 129 R, 129 D

[56] References Cited

U.S. PATENT DOCUMENTS

| | | | |
|---|---|---|---|
| 3,336,067 | 8/1967 | Cloyd | 294/66.1 |
| 3,446,484 | 5/1969 | Walsh et al. | 294/1.1 |
| 5,462,326 | 10/1995 | Doherty | 294/1.1 |
| 5,704,669 | 1/1998 | Clark | 294/19.1 |

*Primary Examiner*—Dean Kramer

[57] ABSTRACT

A small flexible device (12) is used in conjunction with various sized elastic bands (18), one of which is attached to a climbing sling (19). The large diameter end (14) of the retrieval device (12) contains an insertion notch (13) to facilitate the entry of a climbing rope. The rope is inserted the length of a longitudinal through hole (16), by use of the retrieval devices' (12) longitudinal slot (15). The retrieval device (12) is constructed with a small diameter end (17) opposite a large diameter end (14). The small diameter end (17) first passes through the large loop (21) of two loops previously formed in a sling (19) using an elastic band (18). The large diameter end (14) of the retrieval device (12) being smaller than the large diameter loop (21) of the sling (19) passes through the loop (21) unimpeded. The small diameter end (17) of retrieval device (12) then enters the small diameter loop (20) in the sling (19), the diameter of this loop (20) having been previously formed with an elastic band (18). The large diameter end (14) of the retrieval device (12) then enters the small diameter loop (20) in the sling (19). Because the diameter of the small diameter loop (20) is less than the large diameter end (14) of the retrieval device (12), the device will not pass through the loop. This action allows the climber, via the rope, to apply a pulling force onto the sling (19). In continuing to pull the rope in this manner, the rope and retrieval device (12) will pull the sling (19) free from the natural or man made anchor. The rope, sling (19) and retrieval device (12) will then fall free to be retrieved. If the sling (19) should become jammed in the anchor, increasing amounts of force can be applied to the retrieval device (12) until the rope slides through and exits the device. The rope will then fall free and be retrieved.

3 Claims, 3 Drawing Sheets

DEVICE USED IN THE RETRIEVAL OF CLIMBING EQUIPMENT

BACKGROUND OF THE INVENTION

This invention relates to climbing equipment, specifically to the retrieval of such equipment.

In mountain or rock climbing, safety is of prime importance. A climber prevents injury to him or herself by relying on a safety rope to prevent falling potentially fatal distances. A typical climbing rope is usually composed of nylon or other man made compounds, 50 to 60 meters long and 9 to 12 mm in diameter. The climbing rope is carefully placed on the ground and one end is passed through a mechanical device known as a belay tool. This device is then attached to the safety harness of the member of the climbing team designated the belayer. The climbing rope is fed out of the belay tool and tied to the harness of the other member of the climbing team, the climber.

The belayer loosely holds the climbing rope approximately 30-cm from the point at which it enters the belay tool. By changing the angle the rope enters the belay tool, the belayer adjusts the amount of friction on the rope. If the belayer holds it parallel to the rope that leaves the tool and is attached to the climber, the friction is very low. Conversely, if the rope is held at a 90-degree angle to the tool, the friction is sufficiently high to keep the rope from passing through the tool. This action is used to allow the rope to either follow the climber as he or she ascends, or to stop the rope from passing through the tool if the climber falls, thus preventing the climber from falling excessive distances.

For safety, after ascending 2 to 3 meters above the ground, the climber must attach the climbing rope to an anchor location on the rock face. In so-called sport climbing, this location is the first of many permanent, man made anchors bolted to the rock face. In so called traditional or mountain climbing, these man made locations are not available and the climber searches out a place in the rock face for a temporary anchor point. The temporary anchor point is made using one of the mechanical contrivances carried on the climbers' safety harness. They include various shaped cams, nuts, steel shafts and formed metal objects. The type of device used to manufacture the anchor point depends on the rock composition and its natural surface. As an example, the climber may decide to place a spring-loaded cam into a crack in the rock face. The temporary anchor point manufactured in this way is intended to have the same strength and stability as a man made anchor point.

Both the permanent anchors bolted to the rock face and temporary anchor locations made by the climber using a mechanical device have a hole or ring manufactured into them to allow a piece of climbing equipment, called a draw, to be attached.

A draw is assembled with a sling and two carabiners. A sling is a band of heavy nylon webbing, usually 10 mm to 45 mm in width and 20 cm to 2.4 m in length. The ends of the webbing are sewn together to form a continuous loop. A carabiners is a mechanical device, usually D shaped, with a spring-loaded gate on the straight side that automatically shuts when tension on the gates return spring is released. Two carabiners are clipped onto a sling and the assembly is then known as a draw.

As explained above, the climber attaches one of the carabiners on the draw into the permanent man made or temporary anchor. He or she then opens the gate on the second carabiner, inserts the climbing rope and allows the gate to close.

At any time after the first draw is in place, the belayer can prevent the climber from impacting the ground should he or she fall from the rock face. If the climber falls, the belayer quickly pulls the rope to a 90-degree angle from the face of the belay tool. This action stops the rope from passing through the tool. The climber falls until the rope is pulled taut from his or her safety harness, through the draw and down to the belayer. The climbers' weight on the rope is offset by the belayers' weight on the rope and the climbers' fall is arrested. The climber regains his or her position on the rock face and the climb is continued.

The climber ascends until all but last few meters of the safety rope has passed through the belayer's belay tool. The climber then finds a stable position on a ledge, crack or outcropping and attaches a belay tool to his or her harness. After untying the safety rope from his or her harness and passing the rope through the belay tool, the climber becomes the belayer. The original belayer then takes their end of the rope out of their belay tool and ties it to their safety harness. In this manner the original climber now becomes the belayer and the original belayer becomes the climber. As the climber ascends the rock face, he or she retrieves the draws and any mechanical devices that were used to manufacture temporary anchor points. As the climber ascends, the belayer continuously pulls the in safety rope until the climber reaches the position of the belayer. If the climber should fall off the rock face, the action of the belayer, even though they are now positioned above the climber, is the same. The belayer quickly pulls the rope to a 90-degree angle from the face of the belay tool and the climbers fall is arrested.

After the climber reaches the position of the belayer, the draws and mechanical devices are attached to the safety harness of the person making the next vertical ascent and the climb continues. This process continues until the summit is reached or the party can no longer ascend because the requirements of the climb exceed the capabilities of the climbing team. In either situation, the team must then return to the ground.

Returning to the ground is usually accomplished by rappelling. To rappel, one of the climbers attaches a sling directly to the last anchor point reached. If this point is a man-made anchor, the sling is passed through the hole manufactured in the anchor. This is the same hole into which a carabiner on a draw was placed during the climb. A natural rappel point is usually a tree, a crack in the rock face or a large rock outcropping. If a tree is used, the sling is passed around the base. If a crack is used, a small rock, called a chockstone, is jammed into the crack and the sling is passed around the chockstone. If a large rock outcropping is used, a long sling is passed around the outcropping. In all the situations described above, equal amounts of the sling are then positioned on each side of the rappel point.

The climbing rope is then passed through the two open loops of the sling that were formed when the sling was passed through or around the rappel point. The climbing rope is pulled through the two loops in the sling until the entire rope is hanging down below the climbers in two equal lengths. Both lengths of the rope are passed through the first climbers' belay tool and the climber then rappels the length of the ropes. The second member of the team follows the first in this manner. To retrieve the rope, one climber pulls on one of the lengths hanging down from the sling, until the rope falls free from the sling and lands at the climbers' feet. A new rappel point is then prepared as described previously and the team rappels down to the next level. This procedure is repeated until the climbing team reaches the ground.

Because the climbing rope is pulled through and subsequently free of the sling, the sling must usually be abandoned. During a high and difficult climb, up to a dozen slings must be left behind. This is not only costly and unsightly, but also environmentally undesirable.

SUMMARY OF THE INVENTION

The proposed invention comprises a means of retrieving climbing slings.

After due diligence and an exhaustive search, no prior art can be found.

The retrieval device will allow the retrieval of slings that, until now, had to be abandoned. The retrieval device has the following advantages:

(a) It does not compromise the safety of the climbing team.

(b) It is simple to use.

(c) It is lightweight.

(d) Should circumstances cause the device to fail to retrieve the sling, the climbing rope will still be retrieved.

(e) The device is suitable for any diameter climbing rope.

(f) The device can be used in all weather conditions.

DESCRIPTION OF THE DRAWINGS AND REFERENCE NUMBERS

Drawings

REFERENCE NUMBERS

Figure 1A:
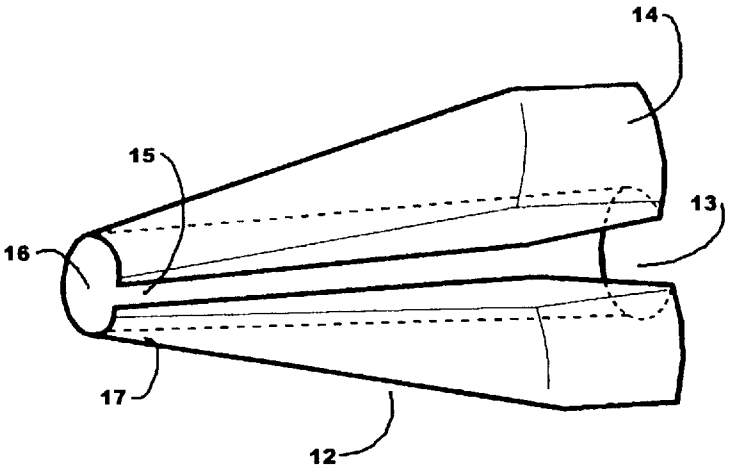
FIGS. 1A and 1B show a front and rear aspect view of a sling retrieval device.

12. embodiment of the retrieval device
13. insertion notch
14. large diameter end
15. longitudinal slot
16. longitudinal through hole
17. small diameter end
18. elastic bands
19. sling
20. smaller loop in a sling
21. larger loop in a sling
22. the rope on the side of the sling without the elastic band attached
23. the rope on the side of the sling with the elastic band attached

DESCRIPTION OF THE PREFERRED EMBODIMENT OF THE INVENTION

Figure 1B:
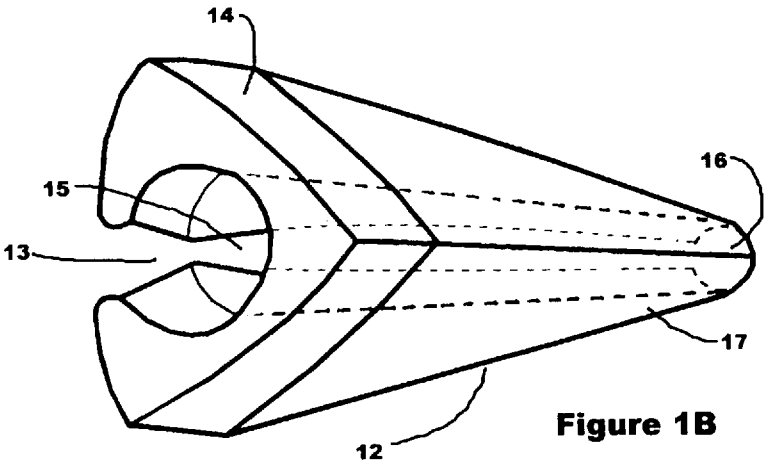
Figure 2:
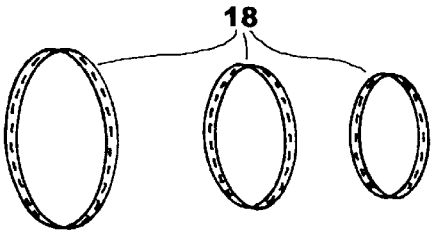
FIG. 2 shows the various sized elastic bands used with the device.
Figure 3:
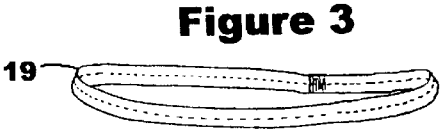
FIG. 3 is a side perspective view of a sling. The sling is not supplied with the device, but is shown to clarify the description of the operation of the device.

A typical embodiment of the present invention is illustrated in FIG. 1A (front aspect) and FIG. 1B (rear aspect). The device comprises a body of flexible material, which is generally indicated by the Reference Numeral 12. The device has an insertion notch 13 at its large diameter end 14. The longitudinal slot 15 and longitudinal through hole 16 continue the length of the device from the large diameter end 14 to the small diameter end 17. Additionally, various sized elastic bands 18 shown in FIG. 2 are supplied with the device to allow attachment to slings of various widths. The sling 19 shown in FIG. 3, is for reference only and is not part of the present invention.

Figure 6:
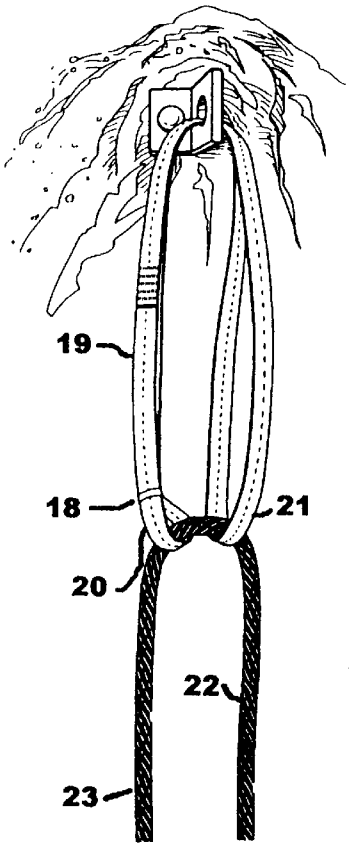
FIG. 6 is a sling with an elastic band installed, positioned into a man made anchor with a climbing rope through the two loops of the sling.
Figure 5:
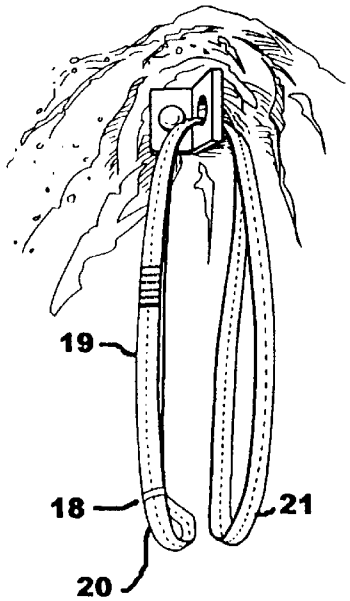
FIG. 5 shows a sling with an elastic band installed that is positioned into a man made anchor.
Figure 4:
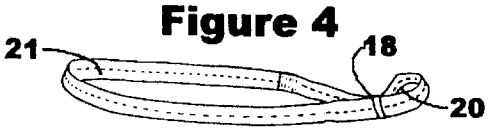
FIG. 4 is a side perspective view of a sling with an elastic band correctly installed.
Figure 8:
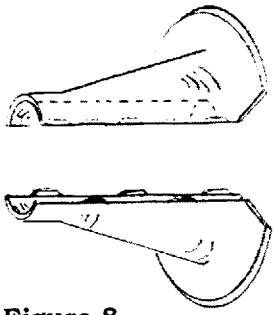
FIG. 8 is a front aspect view of the device when produced as two pieces that interlock.
Figure 9:
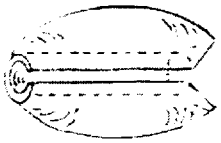
FIG. 9 is a front aspect view of the device when produced in an oval shape.
Figure 10:
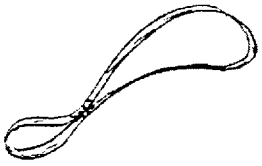
FIG. 10 is a side perspective view of a sling with the loops formed by sewing the sling material together.
Figure 11:
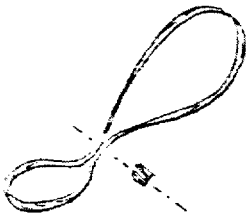
FIG. 11 is a side perspective view of a sling with the loops formed by inserting a tensioning clip.

The climber holds the sling 19 in a flat, closed position and attaches a closing means such as the elastic band 18 around it. The band is positioned approximately 25 mm from the end of the sling. Thus, two loops are formed in the sling, one small loop 20 and one large loop 21 as shown in FIG. 4. The small loop 20 will have a diameter of slightly less than 25 mm. The loops could be formed by any other means, such as clips, sewing the sling closed, tying a cord around the sling, etc. An elastic band 18 is used for simplicity. The sling 19 with the elastic band 18 attached is then passed through or around an anchor point and positioned evenly on both sides of the anchor point as shown in FIG. 5. The climbing rope is passed through and extends down from both loops 20, 21 as shown in FIG. 6. The climbers rappel down these two lengths of rope.

Figure 7:
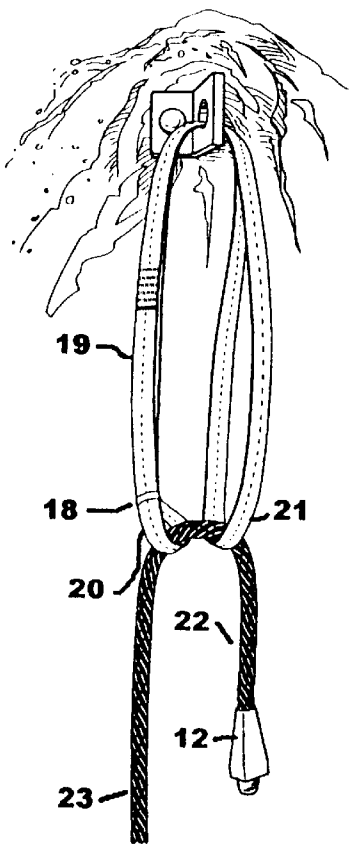
FIG. 7 shows a sling with an elastic band installed, positioned into a man made anchor with a climbing rope through the two loops of the sling and the retrieval device attached to the rope.

After both climbers rappel the length of rope, the sling retrieval device 12 is attached onto the rope as shown in FIG. 7. The climber selects the length of rope 22 extending down from the sling loop that does not have the elastic band 18 attached to it. The small diameter end 17 of the retrieval device 12 is positioned upward toward the sling 19. The rope 22, at a distance ten centimeters from its end, is forced into the insertion notch 13. The rope is then fed into the retrieval device 12 along the entire length of the longitudinal slot 15. The rope will thus fill the longitudinal through hole 16 along the length of the retrieval device 12. The retrieval device 12, being manufactured of a composition that allows flexibility, expands as the rope is introduced along its' length. As the rope is inserted, the retrieval device 12 applies a gripping pressure to the rope along the length of the longitudinal through hole 16. The retrieval device 12 having flexibility, accepts ropes of various sizes and grasps them with noticeable force.

The climber then pulls on the length of rope 23 hanging down from the sling 19 that does not have the retrieval device 12 attached to it. As the climber pulls on the rope, the retrieval device 12 ascends until it reaches the sling 19. The small diameter end 17 of the device enters the large loop 21 in the sling 19 that does not have the elastic band 18 attached. The diameter of the hole in this large loop 21 in the sling is larger than the large diameter end 14 of the retrieval device 12 and the device passes through the loop 21 with little resistance. As the climber continues to pull on the rope, the retrieval device 12 and the end of the climbing rope will pass completely through and exit the large loop 21. As the climber continues to pull on the rope, the retrieval devices' small diameter end 17 then enters the small loop in the sling 20 that has the elastic band 18 attached. The diameter of the hole in this small loop 20, being less than the retrieval devices' large diameter end 14, will not allow the retrieval device 12 to pass through it. As the climber continues to pull on the rope, the retrieval device 12 becomes jammed into the small sling loop 20, allowing a substantial pulling force to be applied to the sling 19. As the climber continues to pull, the sling 19 is pulled free from the anchor point. The climbing rope, sling 19 and retrieval device 12 then land near the climbers' position. The climbers retrieve them, position a sling 19 at another anchor point as described above and rappel down one more level. This process is repeated until the climbers return to the ground.

Although the description stated above contains many specifics, these should not be construed as limiting the scope of the invention but as merely providing illustrations of some of the presently preferred embodiments of this invention.

As an example, the retrieval device can have other shapes, such as oval or triangular shaped. The retrieval device can be made to snap together; the smaller and larger diameters can be of any size or the insertion notch can be an elongated angular slot or rounded cutout. The device can be manufactured of any of the numerous flexible materials available.

Thus the scope of this invention should be determined by the appended claims and their legal equivalents, rather than by the examples given.

I claim:

1. An assembly for the retrieval of climbing gear comprising, in combination:

a flexible body having a first end and second end, the first end having a larger cross sectional area than the second end, an insertion notch located at said first end, a longitudinal slot extending along the length of the body between said first and second ends, and a longitudinal hole extending through the body between the first and second ends, and a sling formed in a closed loop having a closing means for selectively dividing the closed loop into two smaller loops.

2. The assembly according to claim 1, wherein the closing means comprises an elastic band.

3. The assembly according to claim 1, wherein the closing means comprises sewn together portions of the closed loop.

* * * * *